US005161742A

United States Patent [19]

Hofmann et al.

[11] Patent Number: 5,161,742

[45] Date of Patent: Nov. 10, 1992

[54] FUEL INJECTION NOZZLE FOR INTERNAL COMBUSTION ENGINES

[75] Inventors: Karl Hofmann, Neckerrems; Roland Zucker, Bietigheim-Bissingen; Bernhard Kaczynski, Waiblingen; Ursula Schoedel, Bietigheim-Bissingen; Alfred Knauer; Ulrich Lessing, both of Stuttgart, all of Fed. Rep. of Germany

[73] Assignee: Robert Bosch GmbH, Stuttgart, Fed. Rep. of Germany

[21] Appl. No.: 679,045

[22] PCT Filed: May 5, 1989

[86] PCT No.: PCT/DE89/00285

§ 371 Date: May 6, 1991

§ 102(e) Date: May 6, 1991

[87] PCT Pub. No.: WO90/06439

PCT Pub. Date: Jun. 14, 1990

[30] Foreign Application Priority Data

Nov. 30, 1988 [DE] Fed. Rep. of Germany ..... 3840339

[51] Int. Cl.[5] ..... F02M 47/00; B05B 1/30

[52] U.S. Cl. ..... 239/533.9; 239/585.4

[58] Field of Search ..... 239/71, 73, 533.2–533.12, 239/585; 73/119 A

[56] References Cited

U.S. PATENT DOCUMENTS

| | | | |
|---|---|---|---|
| 4,502,326 | 3/1985 | Kaczynski | 73/119 A |
| 4,545,530 | 10/1985 | Hofmann et al. | 239/73 |
| 4,546,739 | 10/1985 | Nakajima et al. | 239/533.4 X |
| 4,573,349 | 3/1986 | Slindee | 73/119 A |
| 4,575,008 | 3/1986 | Kaczynski | 73/119 A X |
| 4,638,659 | 1/1987 | Schiessle et al. | 73/119 A |
| 4,646,975 | 3/1987 | Horn | 239/533.9 X |
| 4,770,346 | 9/1988 | Kaczynski | 239/73 |
| 5,046,472 | 9/1991 | Linder | 239/585 X |

FOREIGN PATENT DOCUMENTS

| | | | |
|---|---|---|---|
| 300198 | 1/1989 | European Pat. Off. . | |
| 964457 | 10/1982 | U.S.S.R. | 73/119 A |
| 2177159 | 1/1987 | United Kingdom . | |

*Primary Examiner*—Andres Kashnikow
*Assistant Examiner*—Lesley D. Morris
*Attorney, Agent, or Firm*—Michael J. Striker

[57] ABSTRACT

An injection nozzle provided with an inductive needle movement sensor is constructed in such a way that a coil winding of the sensor is faultlessly sealed against overflow oil without more space being required for the needle movement sensor than is required in a construction without a sealing of the coil winding against overflow oil. For this purpose, a coil core of the induction coil is lengthened into a lengthened portion of the chamber in a short-circuit body of the sensor, which chamber receives an induction coil, and a sealing ring seals the coil winding against a guide gap of the magneto armature in the short-circuit body. An annular gap between the short-circuit body and a bore hole wall in a nozzle holder receiving is sealed by means of a sealing ring. A clamping flange connected with the coil core directly contacts an adjacent annular flange of the coil body and the coil winding contacts connection wires on the other side of a clamping flange.

21 Claims, 5 Drawing Sheets

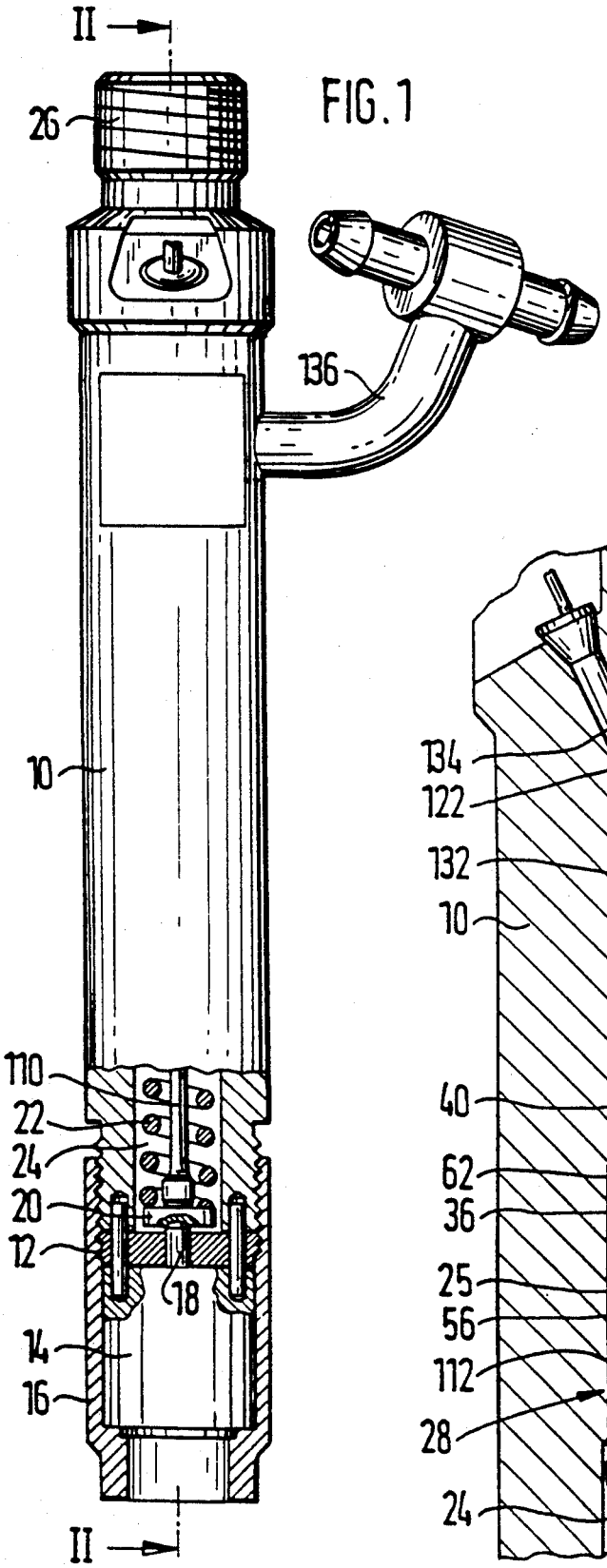
FIG. 1
FIG. 2
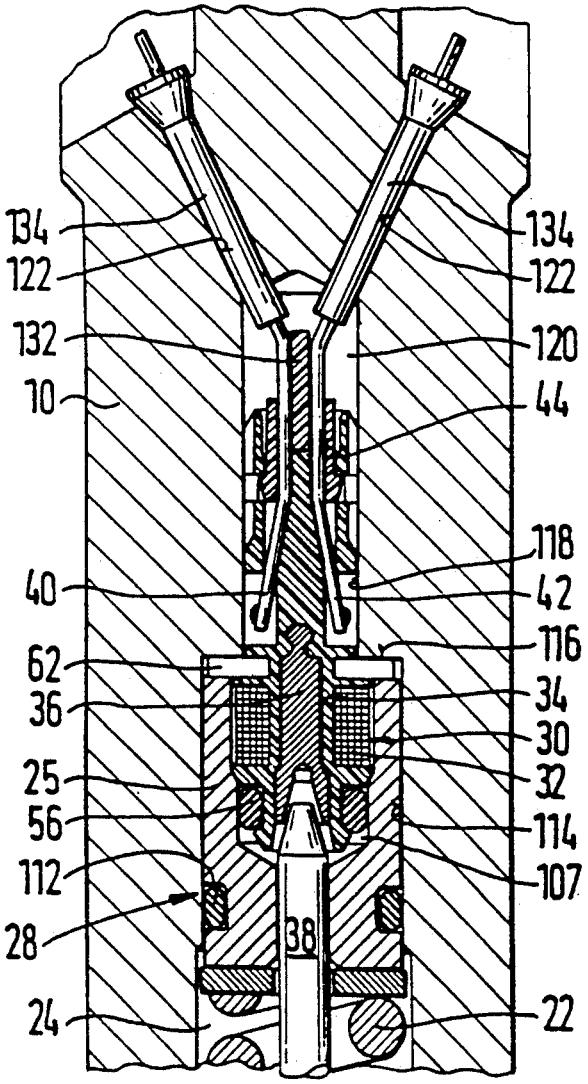

FUEL INJECTION NOZZLE FOR INTERNAL COMBUSTION ENGINES

BACKGROUND OF THE INVENTION

The present invention relates a fuel injection nozzle for internal combustion engine. In known injection nozzles of this generic type (DE-A 35 15 264), the chamber in the nozzle holder receiving the closing spring is connected with a leakage or overflow oil connection via a duct which is guided through the magneto armature, the coil core in the induction coil, the wire guide body, and the installation duct of the needle movement sensor. In this construction the coil winding of the induction coil is not sealed relative to the overflow oil passage, so that the coil winding must be constructed so as to be resistant to fuel. Moreover, the side of the coil core remote of the closing spring is lengthened beyond the connection points of the coil winding with the connection wires, and the ground or short-circuit body is also drawn away in the axial direction over these connection points. There is accordingly a relatively great space requirement in the axial and radial directions, wherein only a relatively narrow annular surface is available at the nozzle holder for supporting the closing spring along the short-circuit body and the clamping flange of the coil core. More space would be required for the needle movement sensor in the axial direction of the injection nozzle if the coil winding were to be sealed relative to the overflow oil passage in this construction.

SUMMARY OF THE INVENTION

It is an object of the present invention to provide a fuel injection nozzle of the above mentioned general type which avoids the disadvantages of the prior art.

In keeping with these objects and with others which will become apparent hereinafter, one feature of the present invention resides, briefly stated, in a plastic injection nozzle for internal combustion engines, in which an annular gap between a short-circuit body of a needle movement sensor and a wall of a bore hole in a nozzle holder, which bore hole receives the short-circuit body, is sealed by means of a sealing ring which preferably sits in an annular groove at the circumference of a portion of the short-circuit body guiding a magneto armature of the needle movement sensor, a coil core of an induction coil of the needle movement sensor projects slightly over an end face of a coil winding facing the closing spring, a chamber in the short-circuit body which receives the induction coil is lengthened beyond the end face of the coil winding facing the closing spring, a sealing ring which seals the induction coil against a guide gap of the magnetic armature in the short-circuit body, is inserted into the lengthened portion of the chamber of the short-circuit body receiving the induction coil, and a chamber in the nozzle holder receiving the closing spring, into which chamber the borehole receiving the needle movement sensor opens, is connected with an overflow oil connection via a duct in the nozzle holder laterally circumventing the needle movement sensor.

The arrangement, according to the invention, has the advantage that the coil winding of the induction coil is sealed in a faultless manner relative to the chamber in the nozzle holder receiving the closing spring without more space being taken up in the axial direction of the injection nozzle than in the known arrangement. Accordingly, this saves the additional space required for accommodating the two sealing rings in that the coil core is also offset into this space, and the needle movement sensor can therefore be constructed in the area of the connection points of the coil winding with the connection wires without being impeded by the coil core.

A particularly compact construction results when the coil body is provided with a annular collar which projects into the lengthened portion of the chamber in the short-circuit body, tightly contacts the projecting end of the coil core, and carries the sealing ring.

The installation of the needle movement sensor into the nozzle holder along with the connection wires already connected with the coil winding is facilitated if the wire guide body is locked with the coil body.

Tension is relieved in a simple manner while simultaneously facilitating the assembly when the connection wires are securely anchored in bore holes of the wire guide body. When the parts are joined the connection wires at the outlet of the wire guide body are bent laterally so that there is an additional tension relieving effect.

The installation duct for the needle movement sensor can be constructed with a particularly small diameter, and without a diametrically enlarged transitional overlapping to the bore hole of the nozzle holder receiving the short-circuit body, if the bore hole in the coil body intended for receiving the wire guide body is connected with the lateral recesses of the coil body, which receive the connection points with the coil winding, via ducts whose openings into the receiving bore hole lie closer together than its openings into the recesses. In this case, there is a significantly wider supporting surface for the closing spring force than in the known construction, so that the original adjustment of the opening pressure of the injection nozzle is maintained for a longer period of time.

A particularly tight and durable construction results if the induction coil is fixed in its installation bore hole in the short-circuit body so as to be free of gaps and secure against shaking by means of an injected plastic, preferably silicon. The injected plastic preferably also fills up the hollow spaces in the area of the electrical connections in the wire guide body so as to be free of gaps.

Manufacturing can be simplified and the available space in the nozzle holder for an overflow oil bore hole and a filter bore hole can be increased if, according to another suggestion of the invention, the end portions of the two connection wires of the induction coil projecting out of the wire guide body are guided out of the nozzle holder adjacent to one another in a single insulating plug so as to be insulated.

A secure connection of the internal connection wires with the individual wires of a connection cable results when the insulating plug carries two metallic solder sleeves, both the internal connection wires and the individual wires of the connection cable being soldered to the latter.

A good anchoring of the individual wires of the connection cable at the nozzle holder and a secure relieving of tension of the electrical connections results when, according to the invention, the end portions of the individual wires of the connection cable are guided through grooves in the outer surface area of the nozzle holder and secured in these grooves by means of subsequent deformation of at least one groove wall area.

It is particularly advantageous if all recesses in the outer surface area of the nozzle holder for receiving the electrical connection means are filled by injection molding with plastic which fixes the parts at the nozzle holder so as to be free of gaps, insulates them outwardly and covers them in a protective manner. The plastic can form a sleeve which encloses the nozzle holder, has the same outer diameter as the nozzle holder and also encloses the end area of the connection cable so as to give it hold and direction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 shows an injection nozzle according to the first embodiment example, partially in side view and partially in longitudinal section;

FIG. 2 shows a longitudinal section, somewhat enlarged compared to FIG. 1, through the needle movement sensor of the injection nozzle according to line II—II in FIG. 1;

DESCRIPTION OF THE PREFERRED EMBODIMENTS

Figure 3:
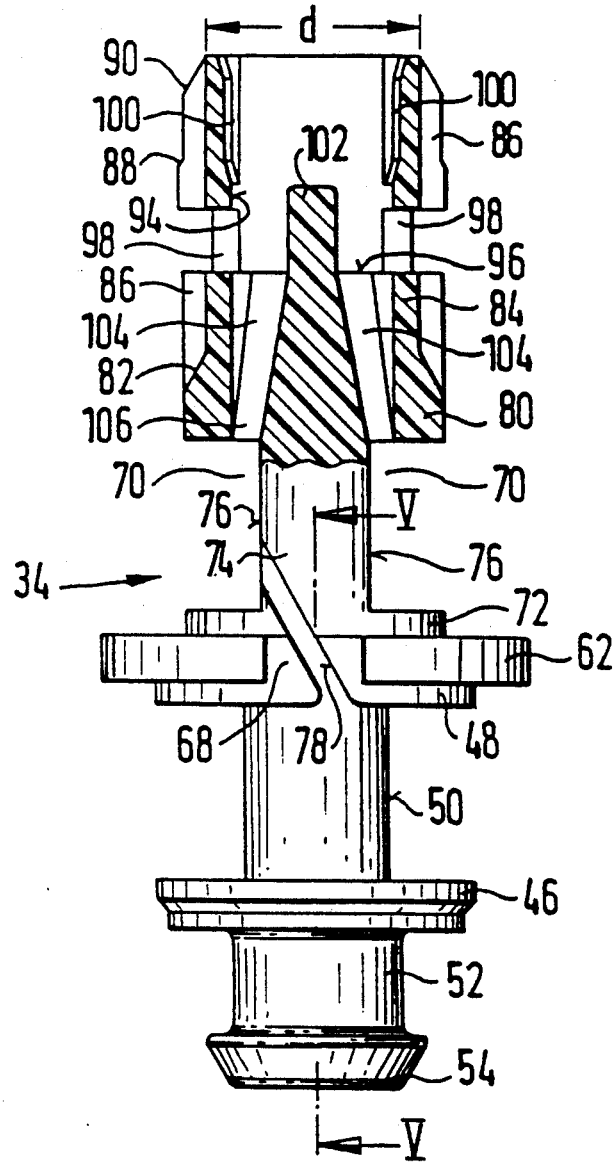
FIG. 3 shows the coil body of the injection nozzle according to FIG. 1 in a side view and partially in section.
Figure 4:
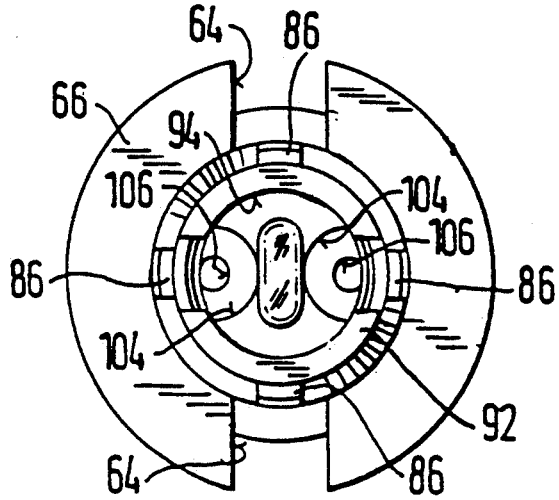
FIG. 4 shows a top view of the coil body.
Figure 5:
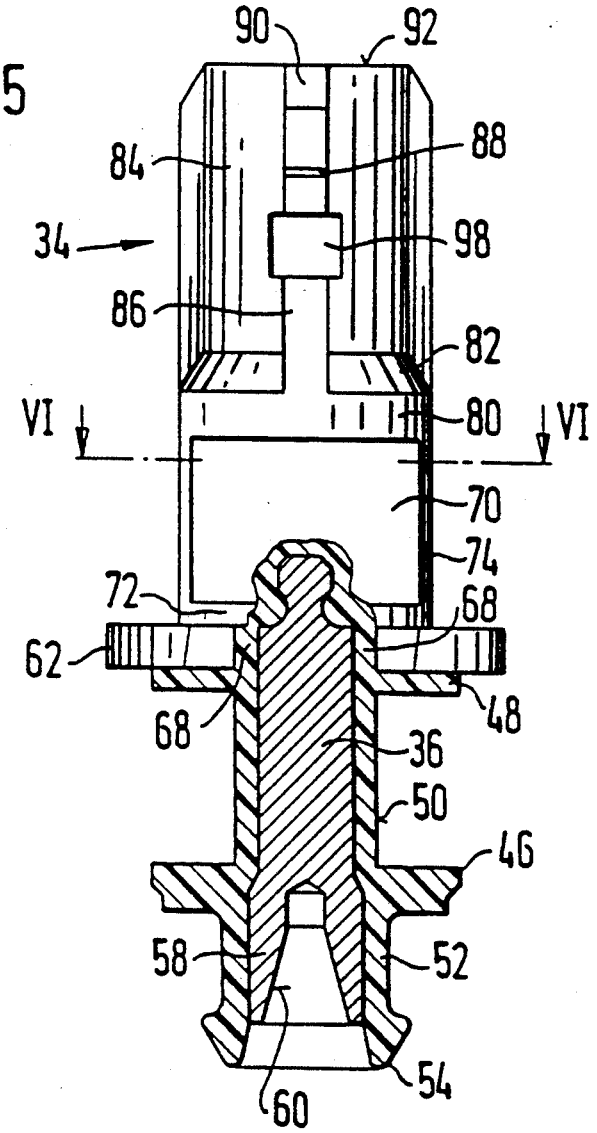
FIG. 5 shows the coil body in a side view which is turned by 90° relative to FIG. 3 and partially in section.
Figure 6:
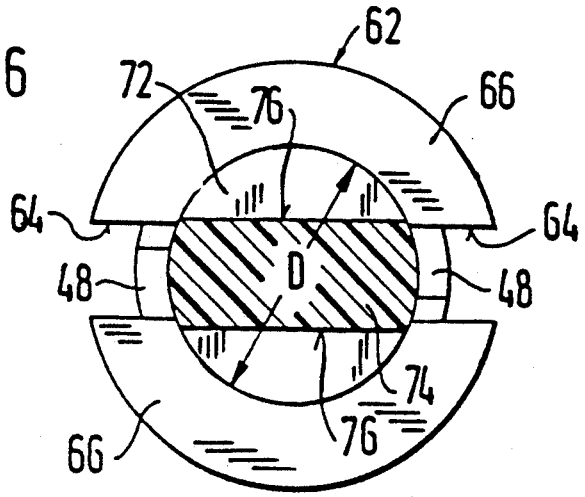
FIG. 6 shows a section according to line VI—VI in FIG. 5.
Figure 7:
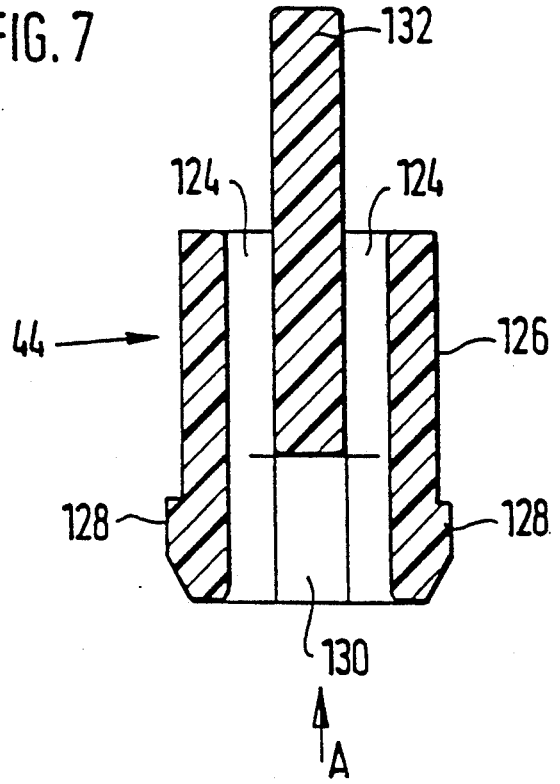
FIG. 7 shows the wire guide body of the injection nozzle, according to FIG. 1, in longitudinal section.
Figure 8:
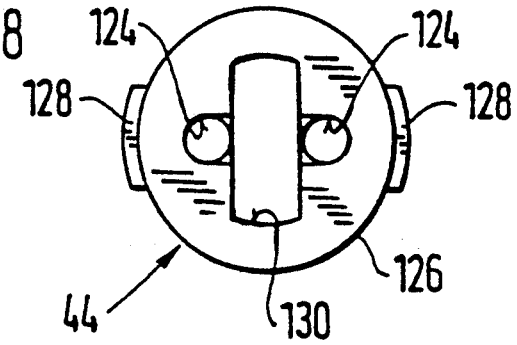
FIG. 8 shows a front view of the wire guide body in the direction of arrow A in FIG. 7.

The injection nozzle according to FIG. 1 comprises a nozzle holder 10, an intermediate plate 12 and a nozzle body 14 being tensioned against the latter by means of a sleeve nut 16. A valve needle 18 is supported in the nozzle body 14 so as to be displaceable. A closing spring 22 which is accommodated in a spring chamber 24 of the nozzle holder 10 acts on the valve needle 18 via a thrust piece 20. The closing spring 22 is supported at the nozzle holder 10 via a magnetically conducting short-circuit body 25 whose construction and twofold function is described in more detail in the following.

The valve needle 18 cooperates with an inwardly directed valve seat in the nozzle body 14 and executes its opening lift opposite the flow direction of the fuel. In a conventional manner, the guide bore hole of the valve needle 18 widens at a point to form a pressure space. The valve needle 18 comprises a pressure shoulder facing the valve seat in the area of the pressure space, the latter being connected with a fuel connection piece 26 of the nozzle holder 10 via ducts, not shown, in the nozzle body 14, in the intermediate plate 12 and in the nozzle holder 10. The fuel pressure act on the pressure shoulder of the valve needle 18 pushes the valve needle 18 upward against the force of the closing spring 22 until a shoulder, not shown, at the valve needle 18 abuts against the lower front side of the intermediate plate 12 and defines the continued upward lift of the valve needle 18.

A needle movement sensor, designated in its entirety by reference number 28, is installed in the nozzle body 10 and can be connected to an evaluating circuit of a control device for the fuel feed or of a test device. The needle movement sensor 28 comprises an induction coil 30 with coil winding 32 and coil body 34, a coil core 36, a pin-shaped magneto armature 38, the short-circuit body 25 serving as support body for the closing spring 22, and two connection wires 40, 42 which are guided through a wire guide body 44. The parts of the needle movement sensor 28 listed above are described in more detail in the following.

The coil body 34 is constructed as a plastic injection molded part; the coil core 36, which consists of soft-iron, being formed in the latter. The coil body 34 comprises two annular flanges 46, 48 which define a first cylindrical portion 50 which carries the coil winding 32. An annular collar 52 adjoins an annular flange 46 at the bottom by its thickened collar rim 54 which is embraced by a sealing ring 56 in the installed state. The coil core 36 is provided with an end portion 58 which projects below the annular flange 46 of the coil body 34, is tightly enclosed by the annular collar 52 and has a conical pocket bore hole 60. An end portion of the pin-shaped magneto armature 38 penetrates into the latter, the end portion being constructed in a correspondingly conical manner.

A clamping flange 62 which is divided into two segments 66 by two diametrically opposite radial cut out portions 64 is formed on in one piece at the upper end at the coil body 34. The clamping flange 62 has a greater outer diameter than the annular flange 46, 48 of the coil body 34 which is formed through the cut out portions 64 of the clamping flange 62 with two webs 68 and continues above the clamping flange 62 as a body whose basic form is cylindrical. This body comprises two segment-like cut out portions 70 which are arranged in such a way that an annular area 72 is formed which overlaps the clamping flange 62 and has a diameter D and a portion 74 with parallel side surfaces 76, which portion 74 is approximately rectangular in cross section. A diagonally extending groove 76 is formed into the webs 68 in each instance, a connection end of the coil winding 32 being guided through the latter in each instance and into the corresponding cut out portion 70.

Above the cut out portions 70, the coil body 34 again forms a full cylindrical annular portion 80 with diameter D which passes at a conical annular surface 82 into a cylindrical portion 84 with the smaller diameter d. Four strips 86 are formed on at the outside at portion 84 so as to be offset by 90° in the circumferential direction in each instance. The outer surface areas of the strips 86 extend parallel to the axis of the coil body 34 lie on an imaginary cylinder with diameter D. The upper portions of the strips 86 slope inward slightly at 88 and pass into the upper front side 92 of the coil body 34 at an inclined surface 90.

The cylindrical portion 84 of the coil body 34 is provided with a pocket bore hole 94 which proceeds from its upper front side 92 and is defined at the bottom by means of a planar base surface 96. Two diametrically opposite wall openings 98 open into the pocket bore hole 94 from the side, the pocket bore hole 94 being provided above these wall openings 98 with wall recesses 100 similar to longitudinal grooves. A projection 102 projects centrally into the pocket bore hole 94 from the base surface 96 and two ducts 104 lead from the pocket bore hole 94 into the lateral cut out portions 70 which narrow in a downward direction in a funnel-like manner to form a circular bore hole 106.

The induction coil 30 is inserted in a chamber of the short-circuit body 25. The chamber comprises a portion 107 which is lengthened in a downward direction and receives both the annular collar 52, which is formed at the coil body 34, and the sealing ring 56 arranged on the annular collar 52. A guide bore hole for the pin-shaped magneto armature 38 adjoins the lengthened portion 107 at the bottom. The coil winding 32 is sealed against the annular gap between the magneto armature 38 and guide bore hole in the short-circuit body 25 by means of the sealing ring 56 which is securely clamped between the bore hole wall of the lengthened portion 107 of the chamber and the annular collar 52 of the coil body 34. The magneto armature 38 is connected via a rod part 110 (FIG. 1) with the thrust piece 20, the closing spring 22 acting on the valve needle 18 via the latter. The short-circuit body 25 carries a sealing ring 112 at the circumference, which sealing ring 112 seals the annular gap between the short-circuit body 25 and the wall of the bore hole 114 in the nozzle holder 10 which receives it.

The short-circuit body 25 lies at an annular shoulder 116 of the nozzle holder 10 with interposition of the clamping flange 62 formed at the coil core 36. The bore hole 114 passes at the nozzle holder 10 into the inner central portion 118 of an installation duct 120, and two diagonal bore holes 122 lead into the installation duct 120 from the outside. An air gap is formed in the magnetic circuit of the induction coil 30 between the conical end portion of the magneto armature 38 and the wall of the conical pocket bore hole 60 in the coil core 36. The size of the air gap varies with the lift of the valve needle 18. The magnetic circuit is closed along a path which is relatively short compared to the known arrangement via the short-circuit body 25 and the clamping flange 62.

The coil body 34 projects snugly into the central portion 118 of the installation duct 120. The conducting wires 40, 42 are connected with the connection ends of the coil winding 32 in the area of the lateral cut out portions 70 in the coil body 34. The connection ends, being placed in the grooves 78 of the coil body 34, are guided through the cut out portions 64 of the clamping flange 62.

The connection ends of the coil winding 32 can be provided with an excess length in the area of the cut out portions 70 of the coil body 34 for the purpose of an additional relieving of tension and for facilitating the connection. The excess length forms a tube or the like in the cut out portions 70. The actual relieving of tension is achieved in that the connection wires 40, 42 are securely anchored in the wire guide body 44 and the latter is locked with the coil body 34. For this purpose, the wire guide body 44 is provided with two axial bore holes 124 in which the connection wires 40, 42, which are snugly guided through, are cemented or secured in some other manner, e.g. pressed in or injection molded.

The bore holes 124 are arranged in a cylindrical portion 126 of the wire guide body 44 whose diameter corresponds to that of the pocket bore hole 94 in the coil body 34 and at which two diametrically opposite catch projections 128 are formed which catch in the lateral wall openings 98 of the coil body 34 when the wire guide body 44 is inserted in the latter. The cylindrical portion 126 is provided in the lower area with a central recess 130 for snugly receiving the projection 102 at the coil body 34. A shoulder 132, which is approximately rectangular in cross section, engages snugly between the two connection wires 40, 42 and holds them apart in an insulating manner, adjoins the cylindrical portion 126. The connection wires 40, 42 are enclosed in the bore holes 122 of the nozzle holder 10 by insulating bushes 134 which are attached and pressed or possibly cemented in the bore holes 122 and extend inward until close to the upper end of the wire guide body 44.

The spring chamber 24 of the nozzle holder 10 is connected with an overflow oil duct, not visible in the drawing, which laterally circumvents the needle movement sensor 28 and leads into an overflow oil connection 136 fastened at the nozzle holder 10.

When installing the needle movement sensor 28 in the nozzle holder 10, the bare connection wires 40, 42 are advisably first guided through the bore holes 124 in the wire guide body 44 along the prescribed length and secured in the bore holes 124. The wire guide body 44, along with the connection wires 40, 42, is thus advanced to the coil body 34 from the beginning in such a way that the connection wires 40, 42 arrive in the ducts 104 of the coil body 34. When inserting the wire guide body 44 into the pocket bore hole 94 of the coil body 34, the free ends of the connection wires 40, 42 are spread apart and guided into the lateral cut out portions 70 of the coil body 34. As a result of the spreading apart, the connection wires 40, 42 are bent at the outlet of the wire guide body 44, so that there is an additional relieving of tension. After the wire guide body 44 locks in the coil body 34, the wire ends are secured at the coil body 34 so as to be free of tension, whereupon they can be soldered with the connection ends of the coil winding 32.

The constructional unit which is thus produced beforehand is now inserted into the short-circuit body 25 and inserted, together with the latter, into the nozzle holder 10 from the side of the spring chamber 24, wherein the coil body 34 enters snugly into the central portion 118 of the installation duct 120 and the connection wires 40, 42 automatically find their way into the bore holes 122 leading outward. Subsequently, the insulating bushes 134 are attached and secured in the bore holes 122. The insulating bushes 134 themselves have no sealing function, since this is already performed by the sealing rings 56, 112 and the overflow oil duct circumvents the needle movement sensor 28.

The coil body 34 can also be provided at its upper portions 80, 84 along the circumference with individual protuberances or the like, which do not impede insertion into the installation duct 120, but additionally clamp the inserted coil body 34 radially and accordingly stiffen the catch connection between it and the wire guide body 44.

Figure 9:
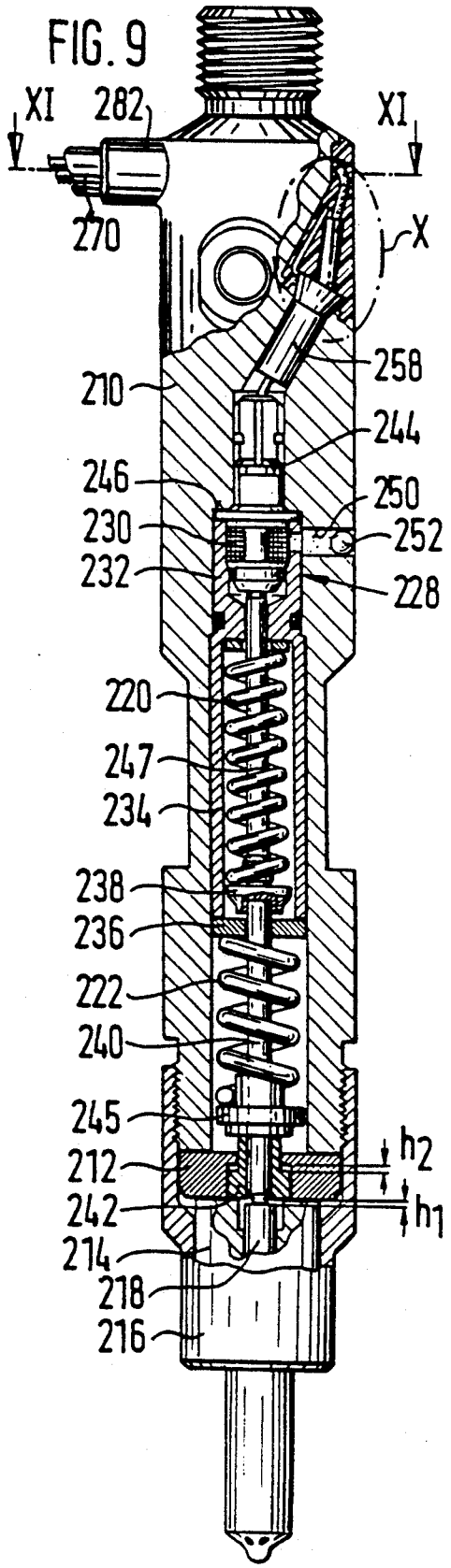
FIG. 9 shows a longitudinal section through an injection nozzle according to the second embodiment example.
Figure 10:
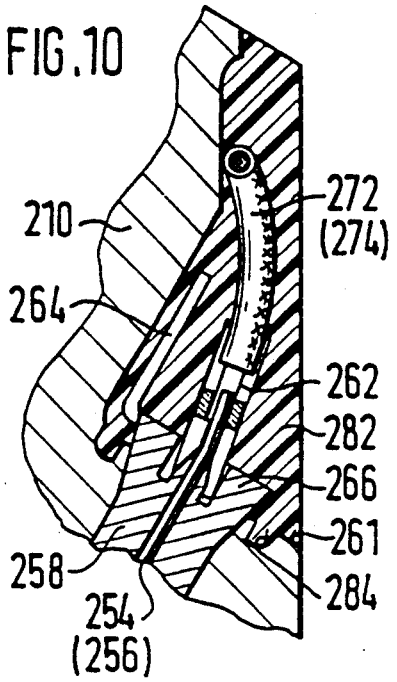
FIG. 10 shows detail "X" of FIG. 9 in enlarged scale.

The injection nozzle according to FIG. 9 has substantially the same housing construction as the previously described embodiment example, namely a nozzle holder 210, against which an intermediate plate 212 and a nozzle body 214 are clamped by means of a sleeve nut 216. A valve needle 218 is supported in the nozzle body 214 so as to be displaceable; however, two closing springs 220 and 222 act at the latter in a manner to be described in the following. Further, a needle movement sensor 228 installed in the nozzle holder 210 also conforms to the embodiment described in the preceding with respect to the construction of an induction coil 230 and a wire guide body 244.

The induction coil 230 sits in a short-circuit body 232 which, in contrast to the construction according to FIG. 2, is provided with a sleeve-shaped shoulder 234 which encloses one closing spring 220 and extends up to a support disk 236 for the second closing spring 222. The sleeve-shaped shoulder 234 could also be formed by means of a structural component part arranged in addition to the short-circuit body, so that the short-circuit body can be constructed so as to be identical to that of the first embodiment example. The first closing spring 220 is supported inside at the short-circuit body 232 and acts at the valve needle 218 via a thrust piece 238 and a pressure pin 240. The pressure pin 240 is guided in the support disk 236 and in a bush 242 so as to be displaceable, the bush 242 being displaceably supported in turn in the intermediate plate 212. The second closing spring 222 presses the bush 242 down against the upper end face of the nozzle body 214 via a thrust piece 245 and holds the short-circuit body 232, including the induction coil 230, in contact with a housing shoulder 246 of the nozzle holder 210 via the support disk 236 at the top.

During the opening lift of the valve needle 218, the upper closing spring 220 first acts alone on the valve needle 218 until the latter abuts against the lower end face of the bush 242 after executing a pre-stroke $h_1$. The opening pressure of the fuel must then also overcome the closing spring 222 until the bush 242 abuts at a shoulder in the stepped guide bore hole in the intermediate plate 212 after a further partial lift $h_2$. A clear reduction of pre-injection and main injection is achieved in different operating ranges by means of this stepped closing force configuration. An armature pin 247 which is guided in the short-circuit body 232 is connected in one piece with the thrust piece 238, penetrates into the induction coil 230 and produces the desired signals by means of its movements.

A transverse bore hole 250 which leads into the receiving chamber for the induction coil 230 via a corresponding transverse bore hole in the short-circuit body 232 is provided in the nozzle holder 210 at the height of the induction coil 230. Silicon is injected into the annular gap between the induction coil 230 and the chamber wall via these transverse bore holes after the assembly of the needle movement sensor 228, and the induction coil 230 is accordingly secured so as to be free of gaps and secure against shaking. The silicon also reaches from the annular gap into the hollow spaces of the wire guide body 244 receiving the coil connections (for details see FIG. 3 to 8) and likewise the fills the latter so as to be free of gaps. After filling with silicon, the transverse bore hole 250 is tightly sealed toward the outside by means of a pressed in ball 252.

Aside from the different closing spring arrangement and the additional securing of the induction coil 230, as well as the plugging of the hollow spaces in the wire guide body 244 with silicon, the difference between the injection nozzle according to FIG. 9 and the first embodiment example also consists in the different construction of the wire guide upstream of the wire guide body 244 and a different cable connection. The two connection wires 254, 256 are not diametrically opposite in the second embodiment example, but rather are guided out of the nozzle holder 210 at one side so as to be located adjacent to one another in an insulated manner in an insulating plug 258. Accordingly, more space is created in the fuel duct for an overflow oil bore hole and a bore hole for a filter body 260 and the external cable connection can also be made more easily, secured and outwardly covered. Further, only one bore hole need be provided in the nozzle holder 210 for guiding through the connection wires 254, 256.

Two solder sleeves 262 are attached adjacent to one another on the insulating plug 258 which opens outward in a recess 261 in the outer surface area of the nozzle holder 210, the ends of the connection wires 254, 256 which project out of the insulating plug 258 being soldered into the two soldering sleeves 262. Further, the insulating plug 258 is provided with an upwardly projecting insulating wall 264 preventing a metallic contact between the solder sleeves 262 and the nozzle holder 210 as well as with an insulating web which extends between the solder sleeves 262 and is not shown in the drawing.

Further, the insulating plug 258 comprises a conical portion 266 which is pressed tightly against a correspondingly conical portion of the bore hole in the nozzle holder 210 receiving the insulating plug 258 by means of the steps described in the following.

Figure 11:
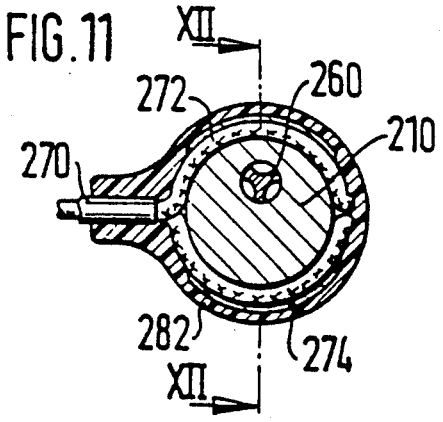
FIG. 11 shows a section according to line XI—XI in FIG. 9.
Figure 12:
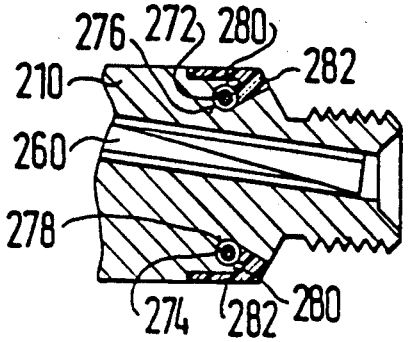
FIG. 12 shows a section according to line XII—XII in FIG. 11.

An electrical connection cable 270 contains two individual wires 272, 274 which are located one above the other, provided with an insulating sheathing and guided to the solder sleeves 262 so as to loop around the nozzle holder 210 according to FIG. 11. Every individual wire 272, 274 is guided through an axially accessible groove 276, 278 in a recessed outer surface area of the nozzle holder 210 and secured in the groove by means of flanging the outer groove wall groove 280. The groove 276, 287 extends along a part of the circumferential outer surface area of the nozzle holder 210. The bare ends of the individual wires 272, 274 are soldered into the solder sleeves 262.

A plastic injection molding 282 arranged in a last work cycle encloses the nozzle holder 210 and the adjacent end area of the connection cable 270 in a sleeve-like manner in such a way that the end area is held at a right angle to the nozzle axis. The plastic injection molding 282 forms an additional securing of the individual wires 272, 274 and also fills out the hollow spaces formed in the recess 261 of the nozzle holder 210 between the parts so as to be free of gaps. The insulating plug 258 is also pressed into its installation bore hole by means of the injection pressure. An annular groove 284 which encloses the insulating plug 258 at a slight radial distance is provided at the base of the recess 261. The plastic penetrating into the annular groove 284 during the injection molding shrinks when cooled and thus exerts an additional radial sealing force on the insulating plug 258.

We claim:

1. A plastic injection nozzle for internal combustion engines, comprising a nozzle body provided with a valve seat; a valve needle guided in said nozzle body so as to be displaceable; a closing spring arranged so that it acts upon said valve needle in one direction, while fuel acts upon said needle in an opposite direction and said valve needle moves against a flow direction of the fuel during an opening lift; a nozzle holder having a chamber receiving said closing spring and also having a bore hole; a needle movement sensor having an induction coil received in said bore hole of said nozzle holder and provided with a coil core, a magnetic short-circuit body enclosing said induction coil, a magneto armature which is moved with said valve needle and guided into said short-circuit body, a coil winding having an end face facing said closing spring, said closing spring holding said short-circuit body against said nozzle holder; a first sealing ring which seals an annular gap between said short-circuit body and a wall of said bore hole in said nozzle holder, said coil core of said induction coil projecting slightly over said end face of said coil winding facing said closing spring, said short-circuit body having a chamber which receives said induction coil and is lengthened beyond said end face of said coil winding facing said closing spring; a second sealing ring which seals said induction coil against a gap between said magneto armature and said short-circuit body and inserted into said lengthened portion of said chamber of said short-circuit body receiving said induction coil, said chamber in said nozzle holder receiving said closing spring being open into said bore hole receiving said needle movement sensor; and an overflow oil connection, such chamber and said nozzle holder receiving said closing spring being connected with said overflow oil connection so as to laterally circumvent said needle movement sensor.

2. A plastic injection nozzle as defined in claim 1, wherein said short-circuit body having a circumference, said first sealing ring being located on said circumference of said short-circuit body.

3. A plastic injection nozzle as defined in claim 1; and further comprising a duct connected with said chamber and said nozzle receiving said closing spring with said overflow oil connection.

4. A plastic injection nozzle as defined in claim 1, wherein said coil body has an annular collar which projects into said lengthened portion of said chamber in said short-circuit body, said coil core having a projecting end which projects slightly over said end face of said coil winding facing said closing spring, said annular collar of said coil body tightly contacting said projecting end of said coil collar and carrying said second sealing ring.

5. A plastic injection nozzle as defined in claim 1; and further comprising a wire guide body cooperating with said coil body and relieving tension for connection of said coil winding; and connection wires, said short-circuit body, said induction coils and said connection wires being inserted in said nozzle holder together; and means forming an installation duct which leads outwards and in which said wire guide body is inserted.

6. A plastic injection nozzle as defined in claim 5, wherein said coil body has an annular flange which covers an adjacent end face of said coil winding and also has a shoulder extending into said installation duct having lateral recesses; and further comprising a clamping flange connected with said coil core and directly contacting said annular flange of said coil body, and also having cutout portions, said coil winding having two connection ends which are guided through said cutout portions of said clamping flange and are connected with said connecting wires inside said lateral recesses in said shoulder of said coil body.

7. A plastic injection nozzle as defined in claim 5, wherein said wire guide body is locked with said coil body.

8. A plastic injection nozzle as defined in claim 6, wherein said coil body has a receiving bore hole, said wire body being locked in said receiving bore hole of said coil body.

9. A plastic injection nozzle as defined in claim 8, wherein said receiving bore hole of said coil body is connected with said lateral recesses in said shoulder of said coil body; and further comprising means forming ducts for connecting said receiving bore hole of said coil body with said lateral recesses of said shoulders of said coil body, said ducts having openings into said receiving bore hole and also openings into said recesses, said openings into said receiving bore hole being located closer together than said openings into said recesses.

10. A plastic injection nozzle as defined in claim 5, wherein said wire guide body has bore holes, said connection wires being securely anchored in said bore holes of said wire guide body.

11. A plastic injection nozzle as defined in claim 1, wherein said induction coil is fastened in said short-circuit body so as to be free of gaps and secure against shaking; and further comprising means for fastening said induction coil in said short-circuit body and including an injected plastic.

12. A plastic injection nozzle as defined in claim 11, wherein said means for fastening in an injected silicon.

13. A plastic injection nozzle as defined in claim 11, wherein said wire guide body has hollow spaces in an area of electrical connections, said injected plastic also filling up said hollow spaces of said area of electrical connections in said wire guide body so as to be free of gaps.

14. A plastic injection nozzle as defined in claim 5; and further comprising a single insulating plug, said connection wires having end portions projecting out of said wire guide body and guided out of said nozzle holder in said single insulating plug so as to lie next to one another in an insulating manner.

15. A plastic injection nozzle as defined in claim 14; and further comprising individual wires of an external connection cable, said insulating plug carrying two metallic solder sleeves, said connection wires and said individual wires of said external connection cable being soldered on at said solder sleeves.

16. A plastic injection nozzle as defined in claim 15, wherein said nozzle holder has an outer surface provided with grooves, said individual wires of said connection cable having end portions which are guided through said grooves in said outer surface of said nozzle holder and fastened to said nozzle holder by deformation of a wall area of at least one of said grooves.

17. A plastic injection nozzle as defined in claim 15, wherein said solder sleeves have a plastic injection molding which secures electrical connections so as to be free of gaps and cover them externally.

18. A plastic injection nozzle as defined in claim 17, wherein said plastic injection molding overlaps end portions of said individual wires of said connection cable, which loops around said nozzle holder in a sleeve-like manner and additionally secures said individual wires.

19. A plastic injection nozzle as defined in claim 17, wherein said plastic injection molding completely fills up said recesses in said outer surface of said nozzle holder and also encloses an adjacent end area of said connection cable so as to provide its hold and direction.

20. A plastic injection nozzle as defined in claim 1; and further comprising a second such closing spring acting on said valve needle and located after said first mentioned closing spring in an axial direction so as to achieve a graduated opening pressure, said short-circuit body being provided with a sleeve-shaped shoulder which encloses one of said closing springs supported at said short-circuit body and forms a support surface for another of said closing springs.

21. A plastic injection nozzle as defined in claim 1; and further comprising a second such closing spring acting on said valve needle and located after said first mentioned closing spring in an axial direction so as to achieve a graduated opening pressure, said short-circuit body connecting a sleeve-shaped insert which encloses one of said closing springs supported at said short-circuit body and forms a support surface for another of said closing springs.

* * * * *